US005551834A

United States Patent [19]

Thompson et al.

[11] Patent Number: 5,551,834

[45] Date of Patent: Sep. 3, 1996

[54] PRESSURE ROLLER MECHANISM FOR STACKING APPARATUS

[75] Inventors: Brian S. Thompson, Derby; Joseph H. Marzullo, Brookfield; Irena Makarchuk, Fairfield, all of Conn.

[73] Assignee: Pitney Bowes Inc., Stamford, Conn.

[21] Appl. No.: 510,208

[22] Filed: Aug. 2, 1995

[51] Int. Cl.[6] ..... B65G 47/04

[52] U.S. Cl. ..... 414/798.7; 271/180; 414/798.6

[58] Field of Search ..... 271/180, 181, 271/273; 414/798.6, 798.7

[56] References Cited

U.S. PATENT DOCUMENTS

| | | | |
|---|---|---|---|
| 3,716,227 | 2/1973 | Bottcher | 271/180 |
| 3,765,523 | 10/1973 | Nakanishi | 271/180 X |
| 4,678,072 | 7/1987 | Kobayashi et al. | 271/181 X |
| 5,244,344 | 9/1993 | Doeberi et al. | 414/798.2 |
| 5,288,066 | 2/1994 | Hain | 271/181 |
| 5,411,249 | 5/1995 | Zouzoulas | 271/181 |

*Primary Examiner*—Karen Merritt
*Assistant Examiner*—Janice L. Krizek
*Attorney, Agent, or Firm*—Angelo N. Chaclas; Melvin J. Scolnick

[57] ABSTRACT

In an envelope stacker, a normal force roller mechanism drives a mail piece vertically then retracts without adding significant torque to the stacker. The normal force roller mechanism is comprised of a frame and a bracket pivotally mounted to the frame, the bracket further having an aperture and an arm with a shaft extending therefrom. An idler roller is mounted to the shaft. A hub having a slot is rotatably mounted to a plate. An assembly is provided for moving the plate in a substantially horizontal direction. A generally L-shaped pin having a first end portion and a second end portion extends through the slot so that the first end portion engages the aperture of the bracket. A spring is mounted onto the L-shaped pin between the second end portion and the hub.

5 Claims, 5 Drawing Sheets

PRESSURE ROLLER MECHANISM FOR STACKING APPARATUS

This invention relates to a pressure roller designed for use in connection with an envelope stacker such as one of the general type shown in the co-pending U.S. patent application Ser. No. 08/510,209, concurrently filed herewith and assigned to the assignee of the present invention.

BACKGROUND OF THE INVENTION

In mail handling machines, moistening devices are used to wet the flap of an envelope in preparation for sealing the envelope. The water causes the glue on the envelope flap to soften and become tacky to the touch. Conventionally, the envelope is fed between two sealing rollers which press the flap against the envelope body to form the seal. Then, the envelope is transported along a transport path to a stacker device. To maintain secure control over the envelope, it is necessary to have pressure rolls spaced at a pitch along the transport path that is less than the height of the envelope. The presence of such pressure rolls makes it difficult for an envelope to be moved in a direction perpendicular to the path of transport for stacking in the desired manner.

Thus, it is an object of the subject invention to provide a pressure roller mechanism for driving a mail piece vertically then retracting without adding significant torque to a stacking apparatus.

SUMMARY OF THE INVENTION

The above object is achieved and the disadvantages of the prior art are overcome by means of the subject invention for a normal force roller apparatus which comprises a frame and a bracket pivotally mounted to the frame, the bracket further having an aperture and an arm with a shaft extending therefrom. An idler roller is mounted to the shaft. A hub having a slot is rotatably mounted to a plate. Means are provided for moving the plate in a substantially horizontal direction. A generally L-shaped pin having a first end portion and a second end portion extends through the slot so that the first end portion engages the aperture of the bracket. A spring is mounted onto the L-shaped pin between the second end portion and the hub.

BRIEF DESCRIPTION OF THE DRAWINGS

These and other objects and advantages of the present invention will become apparent from the following description of the accompanying drawings. It is to be understood that the drawings are to be used for the purpose of illustration only, and not as a definition of the invention.

In the drawings.

DESCRIPTION OF THE PREFERRED EMBODIMENT

Figure 1:
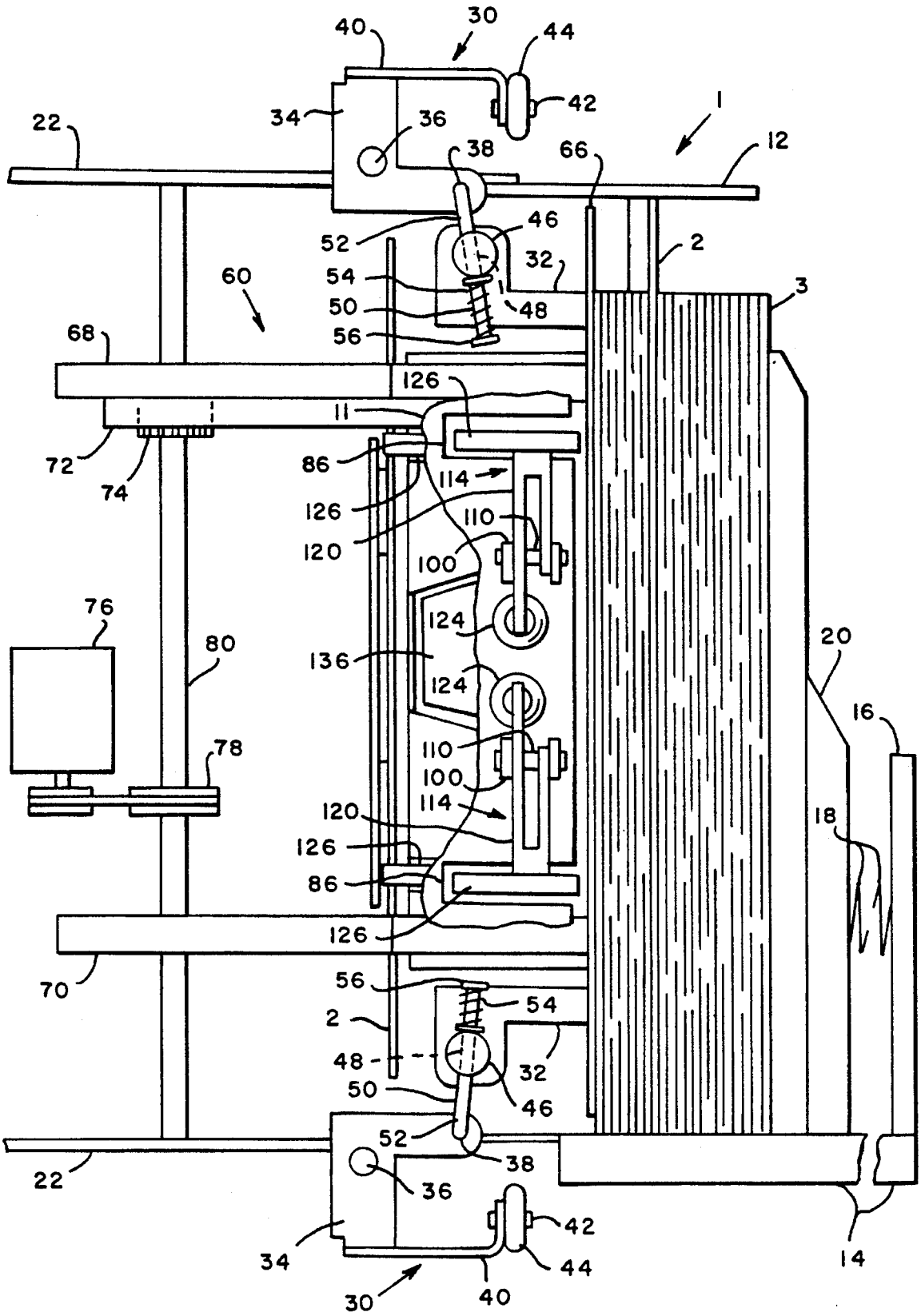
FIG. 1 represents a fragmented, top view of the envelope stacker.
Figure 2:
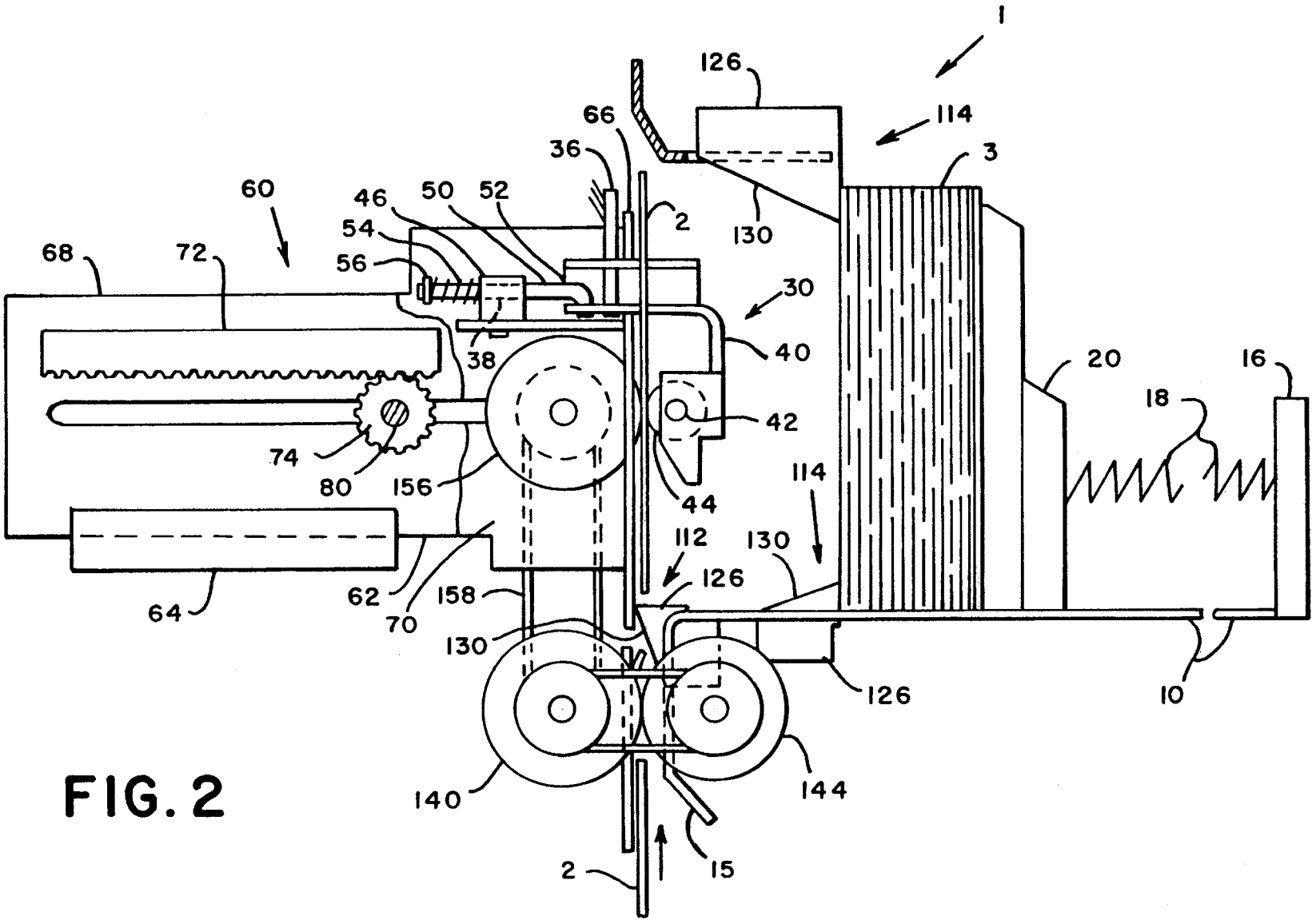
FIG. 2 represents a fragmented, side view of the FIG. 1 stacker.

FIG. 1 AND FIG. 2 illustrate a preferred embodiment showing a top perspective view of an envelope stacker 1 having a lower deck 10 which has fixably mounted thereto, in vertical alignment, transversely spaced apart side walls 12 and 14. The side walls serve principally as a lateral registration abutment for each envelope 2 in the envelope stack 3. Lower deck 10 has a guiding edge 15 for guiding an envelope 2 into the stacker 1. The lower deck 10 is fixably attached to a rear wall 16. A spring 18, having one end fixedly attached to the rear wall 16, and the other end thereof fixedly attached to a plate 20, supplies a biasing force which causes the plate 20 to remain in contact with a forwardmost envelope in the envelope stack 3. The plate 20 serves principally as a longitudinal registration abutment for the envelope stack 3 and secondarily as an obstructing mechanism which halts the forward movement of the envelope stack 3.

Still referring to FIGS. 1 and 2, pivotally mounted to a frame 22 of the envelope stacker 1 at a position approximately equal to half the height of the envelope 2 is a normal force roller assembly 30 which comprises a plate 32 and a bracket 34 having a pivot pin 36 and an aperture 38. The bracket 34 further has an arm 40 with a shaft 42 extending therefrom. An idler roller 44 is mounted to shaft 42.

A hub 46 rotatably mounted to plate 32 has a slot 48 through which extends a generally L-shaped pin 50. A first end portion 52 of the L-shaped pin 50 engages aperture 38 of bracket 34. A spring 54 is coiled around the L-shaped pin 50 between a second end portion 56 of the pin 50 and the hub 46.

A vertically aligned pusher 60 is fixably attached to plate 32. Pusher 60 is comprised of a base 62 supported by guides 64, a forward wall 66, and side walls 68 and 70 in transversely spaced apart parallel alignment. Side wall 68 has mounted thereon a rack gear 72. Pinion gear 74 is operatively connected to the rack gear 72. A motor 76 is in drive communication with idler gear 78 which shares a common shaft 80 with pinion gear 74 whereby rotation of the motor 76 thereby rotates the pinion gear 74.

Figure 3:
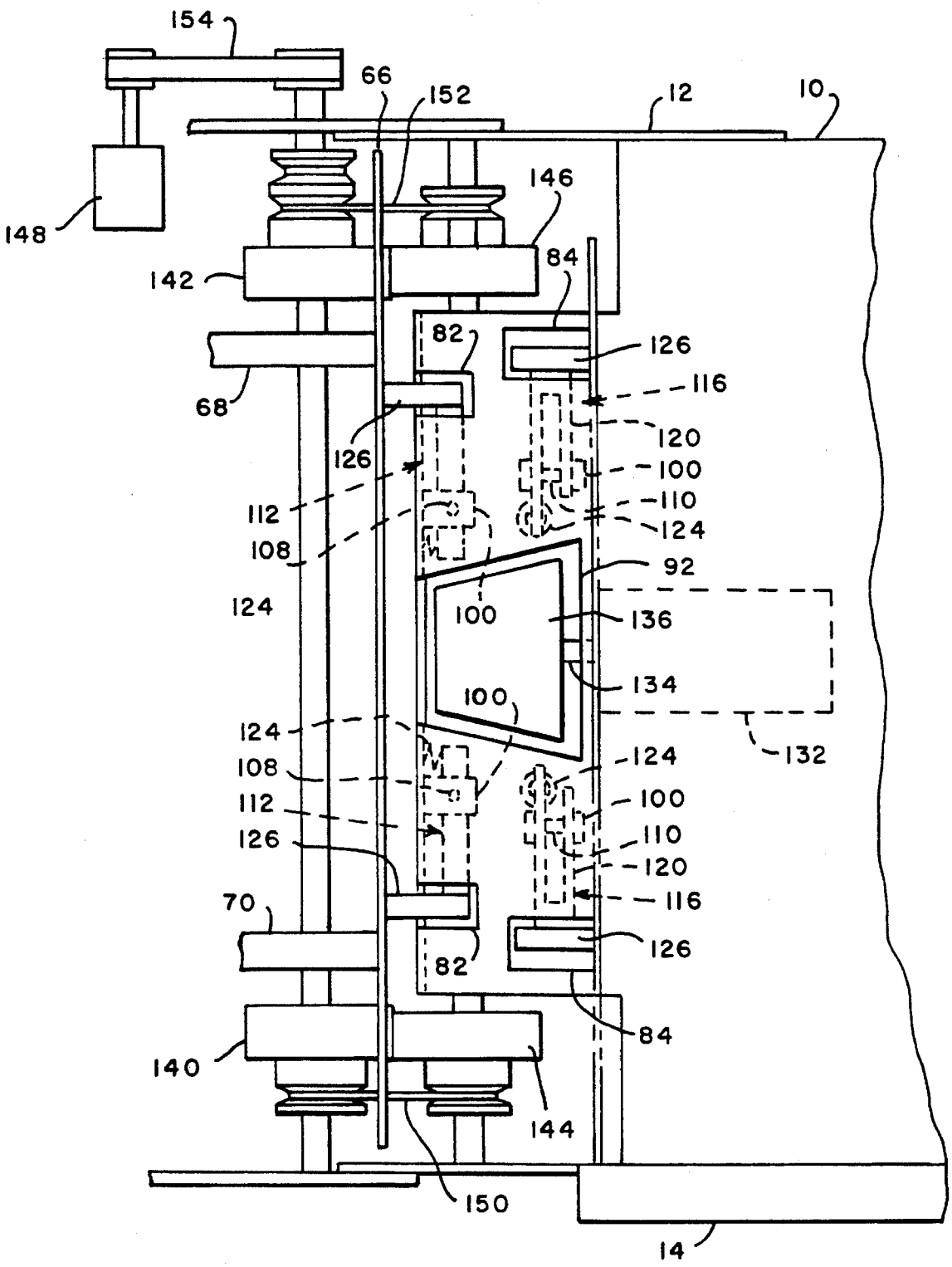
FIG. 3 represents a fragmented, cross-sectional top view of the stacker.

Referring to FIGS. 1 and 3, the lower deck 10 and an upper deck 11 contain a plurality of slots 82, 84, 86, and 92. Fixably mounted to the underside of the lower deck 10 and upper deck 11 are a plurality of substantially U-shaped mounting blocks 100. Each mounting block 100 has a plurality of apertures 108 for receiving a pivot pin 110. Input gates 112 are connected to blocks 100 mounted to the underside of the lower deck 10. Output gates 114, 116 are connected to blocks 100 mounted to the underside of upper deck 11 and lower deck 10 respectively. The gates 112, 114, and 116 include a yoke-shaped end portion 120 pivotally connected to the mounting block 100 by means of pin 110 such that the end portion 120 is oriented parallel to the decks 10, 11. In order to retain the gates 112, 114, and 116 in a home position, a spring 124 is secured to the deck 10 or 11. The spring 124 has a free end which engages the end portion 120 of gates 112, 114, and 116 thereby biasing the gates 112, 114, and 116 toward the home position.

Referring to FIGS. 2 and 3, each gate 112, 114, and 116 further has a front portion 126 having an angled surface 130. The front portion 126 of each gate 112, 114, and 116 extends generally perpendicular to the end portion 120 so that in the home position, the angled surface 130 extends through the slots 82, 84, 86 in the deck 10, 11.

Still referring to FIG. 3, mounted to the underside of the lower deck 10 is a motor 132 having a shaft 134. A generally conical shaped elastomer roller 136 is mounted onto the shaft 134 of the motor 132. The roller 136 extends above the lower deck 10 through slot 92 in deck 10. Roller 136 will rotate in a clockwise or counterclockwise direction depending upon the direction of rotation of motor shaft 134.

Referring now to FIGS. 2 and 3 concurrently, driving means for driving an envelope 2 into the envelope stacker 1 comprises feed rollers 140, 142, 144, 146 rotated by a motor 148 coupled thereto by suitable means such as a pulley drive 150, 152, or 154 entrained about rollers 140, 142, 144, 146. Roller 156 is in drive communication with roller 140 by means of pulley 158. Roller 156 is spaced apart so that a side edge of the envelope 2 engages the roller 156.

PRACTICAL OPERATION

In the operation of the subject invention, it is desirable to provide an envelope stacker 1 wherein a pusher mechanism 60 continuously applies a force to the envelope flap for sealing the envelope 2.

Turning now to FIG. 1, the operation of a specific embodiment of the present invention is illustrated. In the home position depicted in FIG. 1, the pinion gear 74 is in rearmost engagement with the rack gear 72. Accordingly, the pusher 60 is at a forwardmost position so that the forward wall 66 maintains contact with the last fed envelope of the stack of envelopes 3. In the forwardmost position, the pusher 60 applies a force to the last fed envelope to further assist adhesion of the envelope flap to the envelope body. In the home position, the idler roller 44 remains disengaged from feed roller 156.

When the stacker 1 receives a signal that an envelope is being transported to the stacker 1, the motor 76 begins to rotate thereby moving the pinion gear 74 forward within rack 72. This results in the pusher 60 traveling in a rearward direction thereby causing the L-shaped pin 50 engaged with bracket 34 to pivot the idler roller 44 into contact with feed roller 156. The output gates 114 in conjunction with the spring biased plate 20 hold the stack of envelopes 2 in an upright, vertical position to prevent the envelopes from falling back and into the path of an incoming envelope in the absence of pusher 60 (see FIG. 2).

Figure 4:
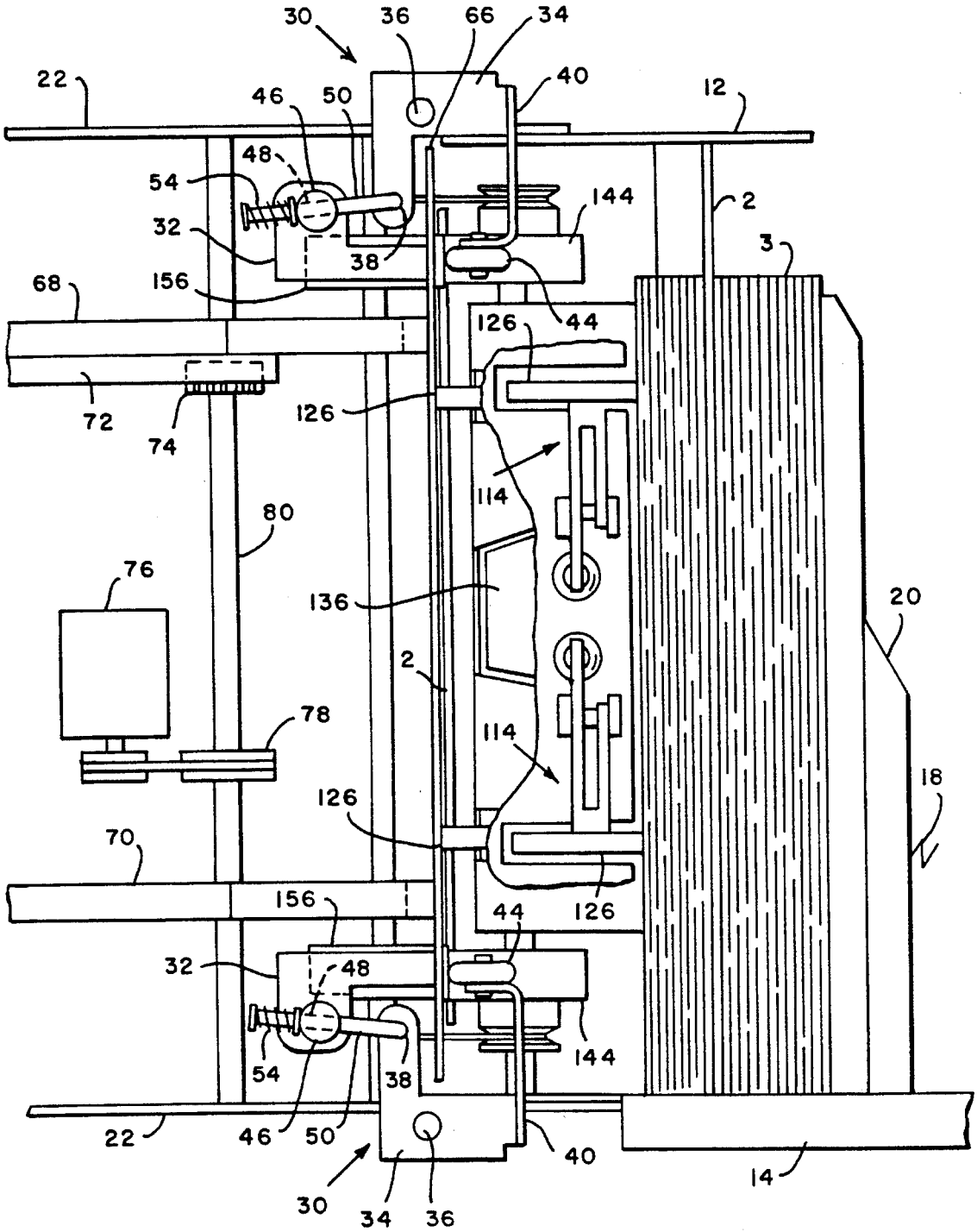
FIG. 4 represents a fragmented, top view of the stacker receiving a mail piece.

Referring to FIGS. 2 and 4, upon receiving an appropriate signal, the driving means drive an incoming envelope 2 into the stacker 1. A vertically fed envelope 2 is guided between the nip of rollers 140 and 144 by the guiding edge 15 of the lower deck 10. The envelope 2 is transported vertically thereby engaging the angled surface 130 of the input gates 112. The driving force of the envelope 2 against the input gates 112 will cause the gates 112 to pivot in a direction perpendicular to the vertical path of travel of the envelope 2 thereby permitting the envelope 2 to engage the nip formed by feed roller 156 and idler roller 44. After the bottom edge of the envelope 2 clears the input gates 112, the spring biased gates 112 will return to the home position and the driving means will cease driving the envelope Referring to FIG. 5, the pinion gear 74 will rotate so as to move the pusher 60 forward. As the pusher 60 advances, the pin 50 engaged with bracket 34 reduces the normal force at the idler roller 44 to zero and the roller 44 pivots out of contact with feed roller 156. Thus, the roller 44 is moved without adding significant torque to the stacker apparatus 1. Pivoting the idler roller 44 will cause the envelope 2 to drop vertically onto the top of the input gates 112. The motor 76 will momentarily discontinue forward motion of the pinion gear 74 as the envelope 2 settles on the input gates 112.

Figure 5:
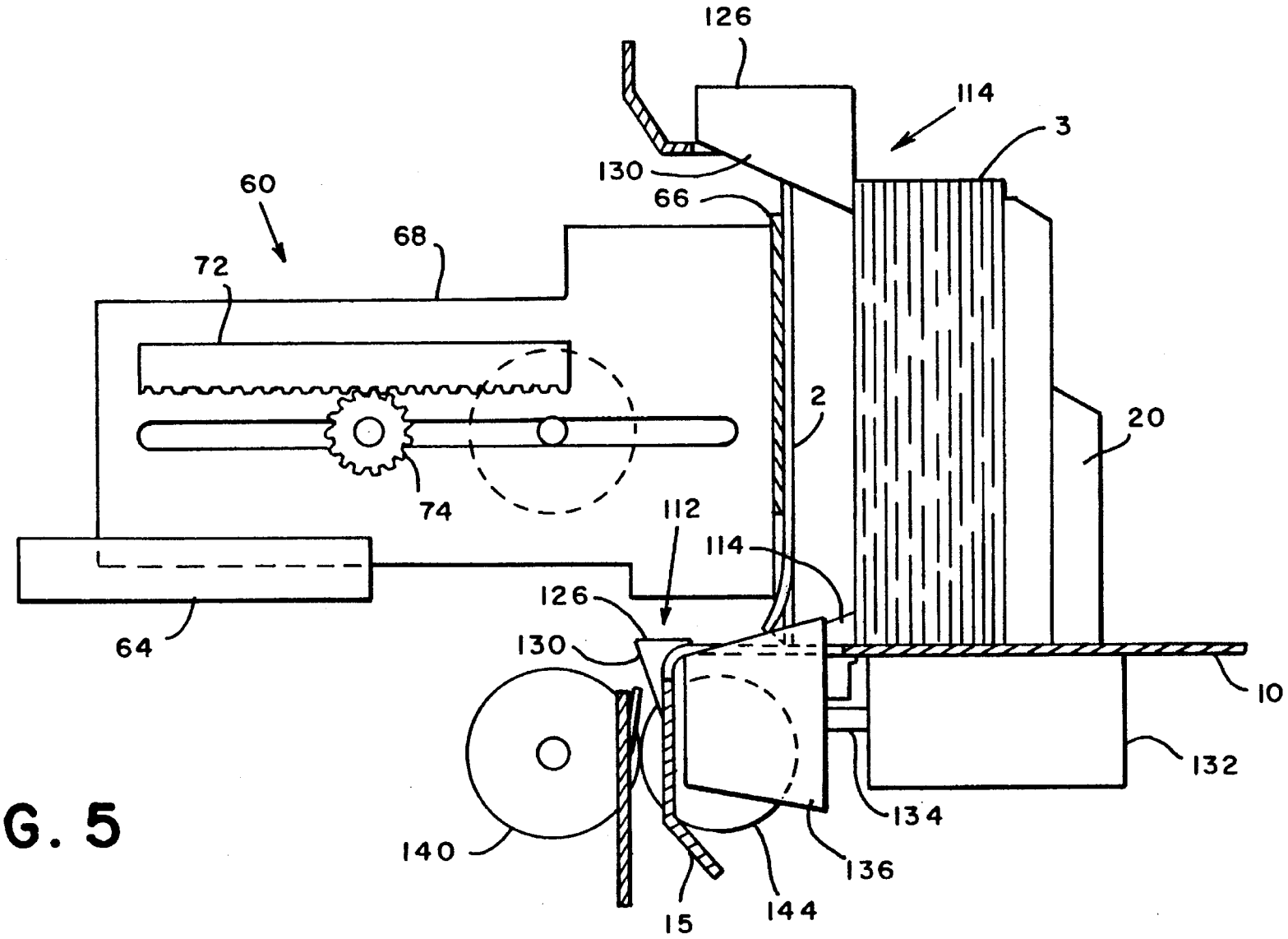
FIG. 5 represents a side view of the stacker receiving a mail piece.

Still referring to FIG. 5, after pausing for a predetermined time, the motor 76 will resume driving the pinion gear 74 so that the pusher 60 moves forward, displacing the vertically oriented envelope 2 in a substantially horizontal direction. As the pusher 60 moves forward, the forward wall 66 drives the envelope 2 into contact with the surface of the elastomer roller 136. The forward motion of the pusher 60 causes the envelope 2 to bend thereby providing additional normal force for driving the envelope 2 forward, across the elastomer roller 136. As the envelope 2 is driven forward, the roller 136 begins to rotate in a predetermined direction. The rotation of the elastomer roller 136 in a predetermined direction will drive the envelope 2 laterally against a side registration edge 12 or 14 to either offset the envelope 2 or register and align the envelope 2 with a common group of envelopes. The pusher 60 continues to drive the envelope 2 forward and into contact with the angled surface 130 of the output gates 114. As the pusher 60 moves forward, the top edge and bottom edge of the envelope 2 causes the output gates 114 to rotate in a direction perpendicular to the horizontal path of travel of the envelope 2.

The foregoing description of the preferred and alternate embodiments of the present invention have been presented for purposes of illustration and description. It is not intended to be exhaustive or to limit the invention to the precise form disclosed. Obviously, many modifications and variations will be apparent to practitioners skilled in this art. The embodiment was chosen and described in order to best explain the principles of the invention and its practical application thereby enabling others skilled in the art to understand the invention for various embodiments and with various modifications as are suited to the particular use contemplated. It is intended that the scope of the invention be defined by the accompanying claims and their equivalents.

What is claimed is:

1. A normal force roller apparatus for use in an envelope stacker having a horizontal deck for supporting a stack of envelopes on edge; a vertical rear wall mounted at a first end of the deck; a transport means located at a second end of the deck for feeding an envelope into the stacker; a pusher wall repositionable along the deck for receiving the envelope at the second end of the deck and pushing the envelope toward the rear wall; and means for repositioning the pusher wall back and forth along the deck; the normal force roller apparatus comprising:

a frame;

a roller; and means for pivotally mounting the roller to the frame to pivot between a first position resulting when the pusher wall is positioned at the second end of the deck wherein the roller is in operative engagement with the transport means to form a nip therebetween and a second position wherein the roller is disengaged from the transport means.

2. The normal force roller apparatus of claim 1, wherein the roller pivots to the second position as the pusher wall pushes the envelope toward the rear wall.

3. The normal force roller apparatus of claim 2, wherein the repositioning mean causes the roller to pivot between the first and second positions.

4. The normal force roller apparatus of claim 3, wherein the roller mounting means comprises:

a bracket having a first end and a second end, the bracket pivotally mounted to the frame between the first and second ends, the roller rotatively mounted to the second end of the bracket; and means for connecting the first end of the bracket to the pusher wall so that, as the pusher wall repositions back and forth along the deck, the bracket pivots causing the roller to engage and disengage from the transport means, respectively.

5. The normal force roller apparatus of claim 4, wherein the connecting mean, comprises:

a plate fixably mounted to the pusher wall;

a hub rotatively mounted to the plate, the hub having a slot;

a pin having a first end portion and a second end portion, the pin extending through the slot so that the first end portion engages an aperture located at the first end of the bracket; and a spring mounted along the pin to extend between the hub and the second end portion of the pin.

* * * * *